United States Patent [19]

Widerby

[11] 4,078,476

[45] Mar. 14, 1978

[54] AIR INLET VALVE FOR ROOMS

[75] Inventor: Lennart Widerby, Jonkoping, Sweden

[73] Assignee: AB Svenska Flaktfabriken, Nacka, Sweden

[21] Appl. No.: 741,681

[22] Filed: Nov. 15, 1976

[30] Foreign Application Priority Data

Nov. 19, 1975 Germany ..... 7537113

[51] Int. Cl.[2] ..... F24F 13/06

[52] U.S. Cl. ..... 98/41 AV; 98/40 B; 251/154

[58] Field of Search ..... 98/40 B, 40 D, 41 AV, 98/114; 251/147, 154

[56] References Cited

U.S. PATENT DOCUMENTS 2,736,255 2/1956 Tutt et al. ..... 98/40 B 3,717,081 2/1973 Jakimas ..... 98/40 B

*Primary Examiner*—William E. Wayner

[57] ABSTRACT

An air inlet valve having a tubular connector having an open end for admitting air to a room, a cover for regulating the quantity and direction of incoming air, and a tubular guide which telescopically engages the connector and mounts the cover for adjustment toward and away from the open end. The guide has a cylindrical wall extending less than 360° to provide a radial inlet opening between the connector and the cover. The guide is frictionally engaged with the connector by a T-shaped leaf-spring. The spring is held against sideways movement by having its upright slidable in the guide and held against vertical movement by having its cross bar anchored in the connector, whereby the guide may be adjusted both circumferentially and axially relative to the connector.

16 Claims, 5 Drawing Figures

AIR INLET VALVE FOR ROOMS

The present invention concerns a valve, specifically an air intake valve for rooms.

Such valves are employed for airconditioning, e.g., for supplying fresh air and/or conditioned air, and are usually installed in the ceiling or walls of a room. The valve is the mouth or opening of a supply duct for air, usually not regulated quantitatively, which is controlled by the valve with respect to quantity and/or the direction of flow.

Previously, so-called poppet or disk valves have been employed on a large scale for one or more of these purposes, with disks mounted on a threaded bolt and screwed in or out in relation to their seat in order to so reduce or enlarge the width of the gap between seat and disk, thereby achieving the desired quantity regulation of the emerging air. Although it is possible to achieve infinitely variable quantity regulation of the inflowing air in this manner, such disk valves entail various disadvantages. Thus, it is impossible to direct the emerging air in a specified direction, and disk valves are also relatively expensive to manufacture and complicated in assembly.

To the extent that other valves of this type have become known, they are also to be regarded as disadvantageous in various respects.

Therefore, the invention has the task of counteracting the above-named disadvantages and of eliminating them as much as possible, and quite generally of advancing the state-of-the art in this field and of finding an economical and advantageous technical solution for the exisiting problem.

These tasks are fulfilled according to the invention which envisions a valve of the type initially mentioned, essentially as in the characterizing part of claim 1. Such a valve is extremely rapid and simple in installation without the danger of unintentional disengagement. A rapid and infinitely variable fine adjustment is possible in the simplest manner, and the outflowing air can simultaneously be controlled or guided in any direction. Any possible irregularities in the vicinity of the opening in which the valve is seated are essentially externally covered by the valve, on the one hand, and such irregularities in the opening, in themselves, present no difficulties with respect to the installation of the valve in accordance with the invention, on the other, since, due to its design, it automatically adjusts itself even to rather large irregularities. Moreover, the valve according to the invention requires no maintenance, and a change in the setting can be accomplished easily and rapidly at any time by anyone without using tools. Such a valve also avoids flow through air-impeding devices, such as are always present in disk valves, since in such case the threaded bolt must be screwed into the cross bar which cuts diametrically across the valve.

Other features and advantages of the invention may be perceived from the following description, with reference to the appended drawings, in which.

Figure 1:
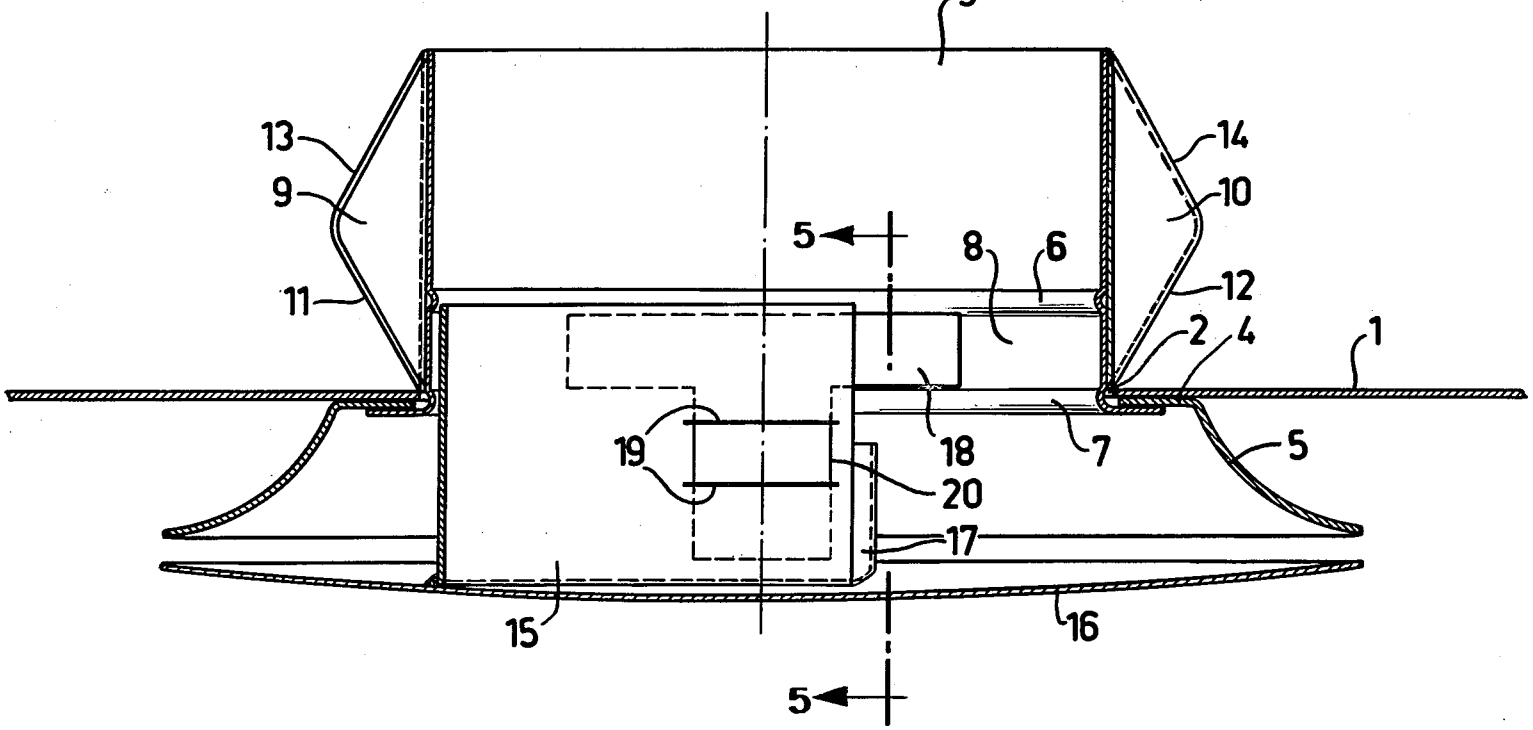
FIG. 1 shows a valve in accordance with the invention, particularly an air intake valve for rooms, in a partially schematic, diametrical-axial cross-section.
Figure 2:
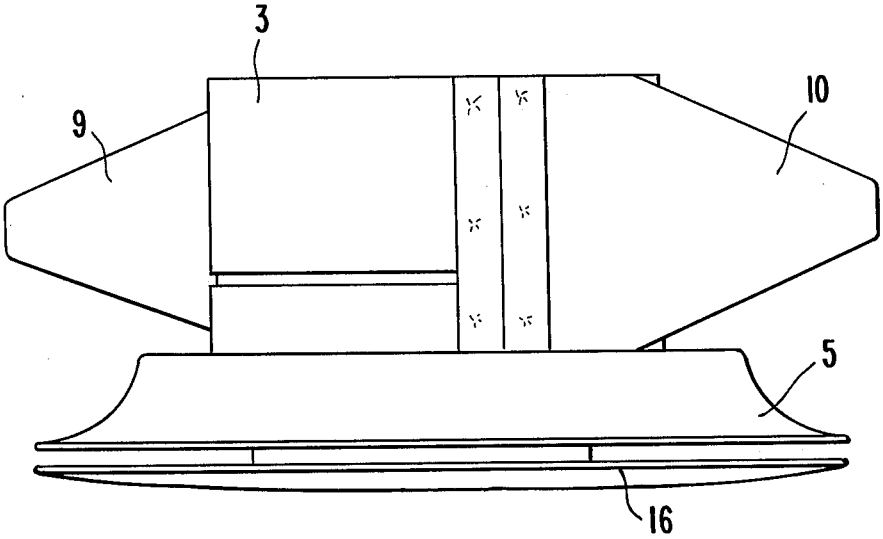
FIG. 2 shows a side view of the same valve.
Figure 5:
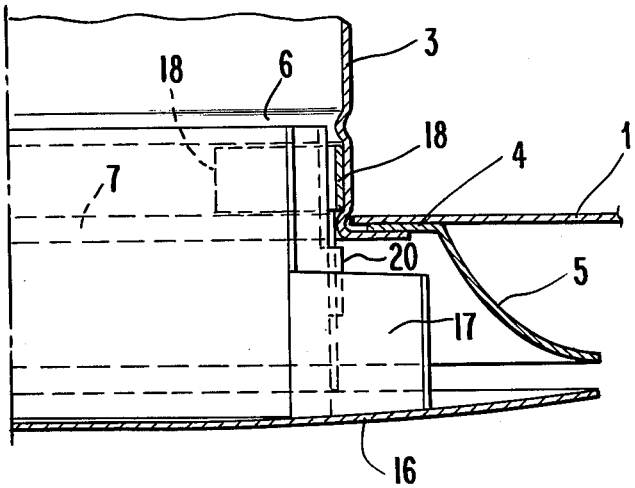
FIG. 5 is a fragmentary sectional view on the line 5—5 of FIG. 1.
Figure 3:
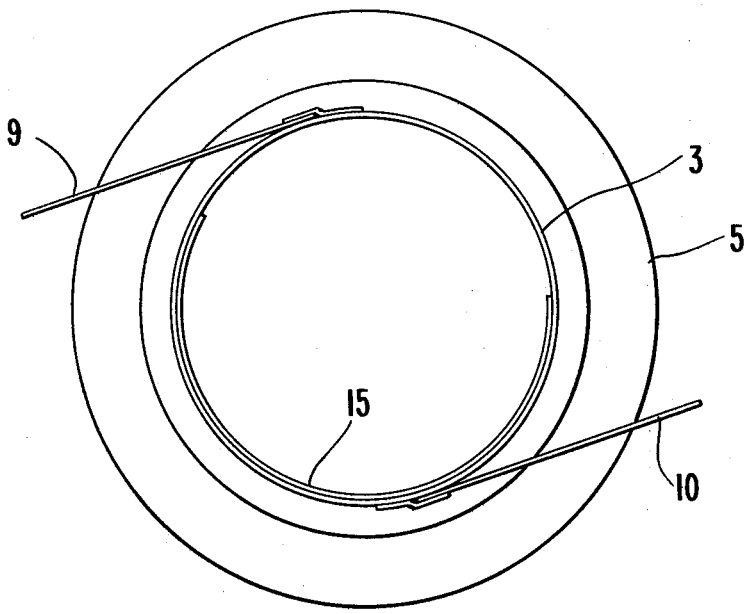
FIG. 3 shows a top view of the same valve.
Figure 4:
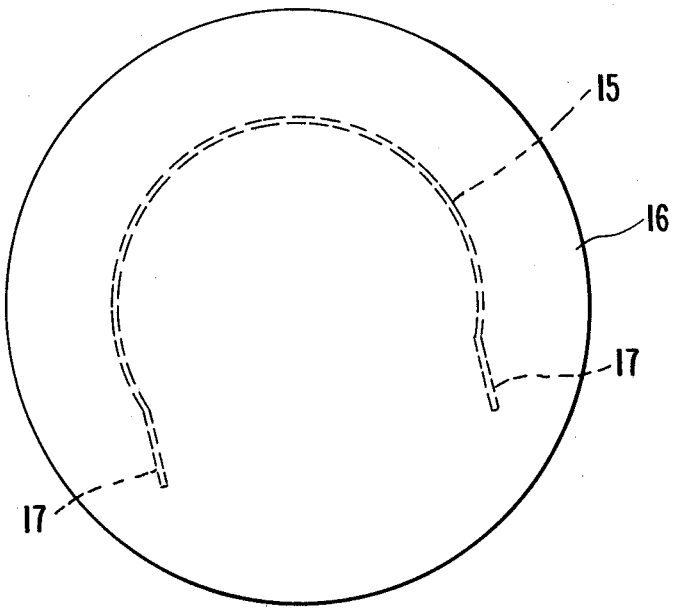
FIG. 4 shows a buttom view of the same valve.

In FIG. 1, the number 1 indicates a ceiling, wall or the like of a room, in which, e.g., a circular opening 2 is provided. In this opening 2, a short connector, such as a segment of pipe or a nipple 3 is introduced, so that a radial collar or flange 4 lies next to the ceiling or the like 1 on the room side or front side of said ceiling 1, from which flange, a bell-like shield 5 extends down in the direction of the outer margin.

In a preferred embodiment, the nipple 3 and one part of the flange 4 are formed from a single workpiece, while the shield and another part of the flange 4 are formed from another workpiece. The two flange parts can thus overlap in order to be joined by spot-welding, gluing, etc.

The nipple 3 displays reinforcing beads 6 and 7, preferably in the region of its flange-side end, which form ridges, preferably protruding into the nipple and spaced relative to each other in such a way that a peripheral seating strip 8 is formed between the two reinforcing beads 6 and 7 in the axial direction.

Two vanes or wings 9 and 10 extend tangentially in opposite directions away from nipple 3, preferably extending the entire height of the nipple 3 and preferably being welded to it tangentially, e.g., by spot-welding. In this case, it can be advantageous for the wings to display edges running parallel to one another in their coupling zone in order to form a sloping edge 11 and 12 connected to said parallel side edges, at least confronting the flange side, but to which, preferably, a corresponding slope 13 or 14 belongs on the other side, so that the wing assumes a trapezoidal or traingular shape. In this way, the wings 9 and 10 which are preferably formed of spring steel, are self locking, since when the valve is used against their spring action they are forced against the nipple and subsequently straighten out, as shown in the figures, at which time they strike against the opening 2 on the back side of the ceiling or the like with their sloping edge 11 or 12.

A guide 15 is concentrically inserted into the connector 3 from the room side and its periphery has the shape of a partial cylinder, i.e., having an arc cross-section less than 360°. The arc can extend over any range of degrees, but preferably encompasses more than 180°, specifically in the range of 200°–240°. In this last-mentioned way, a secure seat is achieved. In the region of the shield 5, a valve cover 16 is butt-affixed, e.g., by welding, to the end of the guide jacket. If desired, the guide end in question can be flanged out in the conventional manner in order to form a better means of attachment to this zone. The profile shape of the cover 16 conforms to that of the shield 5, as shown in the figures. The cover is preferably of plane convex shape, i.e., its center is most remote from the shield. In this way an advantageous guide for the airstream is achieved.

In a preferred embodiment, tabs 17 extend outwardly from the lower (nearer the lid) region of the axial side edges of the cylindrical portion of the guide so that an advantageous deflector for the airstream is also assured in this region. These tabs can also simultaneously serve as stopping means when the guide 15 is inserted into the connector 3. Since the cover 16 is usually made from elastic material, the tabs 17, as stops, can prevent the cover 16 from bending into the shield 5, or even be secured so that a certain minimum gap always exists between shield 5 and cover 16. It is also possible, when necessary, to subsequently bend the tabs 17 in or out at their junction with the cylindrical portion so that an individual setting, i.e., wide or scatter for the emerging air is possible.

The guide jacket 15 with the disk 16 is subjected to friction locking in the connector 3 by a T-shaped leaf-spring 18 made of spring steel. In the unloaded state, this leaf-spring lies in a single plane. This spring is mounted flatly with its upright on the outside of the guide in the axial direction which, in a preferred embodiment, is accomplished by providing the guide 15 with two parallel cuts 19 in the peripheral direction, which form a bridge 20 between them, which is slightly offset outwardly. In the intervening space thus formed between the bridge 20 and the axially adjoining regions of the guide 15, the T-upright is inserted, as shown in FIG. 1. In this case, the upright portion undergoes an elastic deformation in accordance with the radius of curvature of the cylindrical portion of the guide so that an advantageous friction lock occurs between the T-support and the guide jacket. The cross bar of the T-shape leaf-spring 18 engages the circumferential seating strip 8 between the two reinforcing beads 6 and 7 and is held in this position by them. Here also, advantageous frictional locking occurs as a result of the fact that the T-bar tends to straighten out flatly, at which time it is elastically deformed by the curved strip 8.

The valve according to the invention is preferably assembled before insertion in opening 2, in which case the desired setting can already be made, i.e., the gap width between the shield and lid is adjusted by pushing in or pulling out the guide jacket relative to the connector 3. In this case, therefore, the support of the T-shaped leaf-spring slides relative to the guide with a bridge, while the T-shaped leaf-spring itself maintains its position between reinforcing beads 6 and 7 relative to connector 3 because of its locking. At this time, the frictional locking of this type permits an infinitely variable rotation of the cover and the guide relative to the connector 3, since the yoke of the T-shaped leaf-spring can naturaly slide on the strip 8 so that the radial outlet opening of the guide can be aligned in any direction.

Consequently, according to the invention, simple and effective locking is achieved with a single locking device, not only in a certain relative position between the connector and the guide but also in any infinitely adjustable relative axial positions, and an infinitely variable twisting or relative rotation position between these two parts is additionally possible independently of the aforesaid relative positions. The devices necessary for this (6–8 and 18–20) are extremely simple to manufacture and use and are not only inexpensive but also insensitive to disturbances, unsusceptible to damage, and also have a practically unlimited service life.

The embodiments described above and shown in the drawings are to be regarded as nonlimiting examples which can be modified and supplemented as desired within the limits of the idea of the invention. Thus, the guide 15 naturally need not absolutely have the form shown in the drawing. It can assume any other form and also be divided into several parts, so that, e.g., several radial discharge openings are formed. Likewise, naturally, the leaf-spring 18 can also be provided in any number. It is possible to use only one such spring, but it is most advantageous to employ two diametrically opposite leaf-springs. The wings 9 and 10 can also be present in different numbers. In particular, the attachment of the T-support to the guide can have a different configuration, e.g. by means of longitudinal holes in the axial direction and a screw-nut connection or the like. Naturally, several bridges 20 can also be provided. Instead of having a T-shaped, the leaf spring 18 can also have a different shape, e.g., a U-shape, where the two legs of the U could collaborate in the same manner as the T support with the guide.

I claim:

1. An air-inlet valve for supplying and regulating the quantity and direction of the incoming air having a cover, a tubular connector which can be put into an opening in a wall or in the ceiling, and adjustable means providing a connection between the connector and its cover to position said cover spaced from the end of said connector, characterized in that the said adjusting means comprises a tubular guide telescoping with said connector and having a cylindrical periphery less than 360° to provide at least one radial outlet opening between the cover and the connector, and elastically-deformable leaf-spring means disposed between the connector and the guide so that the leaf-spring means effects frictional immobilization of the guide relative to the connector.

2. A valve according to claim 1 characterized in that the connector at its cover end has a radially extended flange and a bell-shaped shield extending toward said cover.

3. A valve according to claim 2 characterized in that the flange comprises two parts, the connector and one part of the flange being made in one piece, and the shield and the other part of the flange being made as another piece, the two flange parts overlapping and being joined by spot-welding.

4. A valve according to claim 2 characterized in that the connector has flexible wings extending tangentially in different directions to cooperate with said flange to anchor said connector in the opening.

5. A valve according to claim 4 characterized in that the each wing extends substantially for the height of the connector and has a slanting edge confronting said flange.

6. A valve according to claim 4 characterized in that the wings are made of spring-steel.

7. A valve according to claim 2 characterized in that the cover shape and size conforms to the shield and is convex.

8. A valve according to claim 1 characterized in that the cylindrical periphery of the guide is in the range of 200° to 240°.

9. A valve according to claim 1 characterized in that the cover abuts and is attached to the guide by welding about said cylindrical periphery.

10. A valve according to claim 1 characterized in that the guide has tabs extending funnel-wise outward adjacent the cover.

11. A valve according to claim 10 characterized in that the tabs are adapted to abut against the connector to limit the inward movement of the guide toward the connector.

12. A valve according to claim 1 characterized in that the connector has beads extending around its periphery forming ridges extending into the connector and which are spaced apart from one another to provide a seat for the leaf-spring means.

13. A valve according to claim 1 characterized in that the leaf-spring is T-shaped and is made of spring-steel.

14. A valve according to at claim 13 characterized in that the spring is anchored on the cylindrical periphery of the guide with the upright of said T being directly axially of said cylindrical periphery.

15. A valve according to claim 14 characterized in that the guide in the region of the leaf-spring has two parallel cuts to form an offset bridge, said upright of the spring being anchored between said bridge and the adjoining region of the guide.

16. A valve according to claim 13 characterized in that the cross bar of the T-shaped leaf-spring bears on the seat between the two beads and is held in this position by elastic deformation.

* * * * *